US011086352B2

(12) United States Patent
Maloney et al.

(10) Patent No.: US 11,086,352 B2
(45) Date of Patent: Aug. 10, 2021

(54) LOCKOUT FOR PENDANT CONTROL OR OTHER TERMINALLY-POSITIONED STRUCTURE ON A CORD

(71) Applicant: Brady Worldwide, Inc., Milwaukee, WI (US)

(72) Inventors: Ryan J. Maloney, Milwaukee, WI (US); Andrew N. Enger, Muskego, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 400 days.

(21) Appl. No.: 16/243,471

(22) Filed: Jan. 9, 2019

(65) Prior Publication Data

US 2020/0218306 A1 Jul. 9, 2020

(51) Int. Cl.
*H01H 9/28* (2006.01)
*G05G 5/28* (2006.01)
*E05B 73/00* (2006.01)

(52) U.S. Cl.
CPC ..... *G05G 5/28* (2013.01); *E05B 73/0005* (2013.01); *H01H 9/287* (2013.01)

(58) Field of Classification Search
None
See application file for complete search history.

(56) References Cited

U.S. PATENT DOCUMENTS 4,802,773 A * 2/1989 Gross ..... B65D 29/00 383/16
4,869,683 A * 9/1989 Nelson ..... H01R 13/5213 439/369
5,566,847 A * 10/1996 Ali ..... H05K 5/0208 217/57
D410,435 S * 6/1999 Hambleton ..... D13/156
6,963,037 B1 11/2005 Bennett et al.
8,605,892 B1 * 12/2013 Owens ..... H04M 1/17 379/452

(Continued)

FOREIGN PATENT DOCUMENTS

DE 952285 C 11/1956

OTHER PUBLICATIONS

European Patent Office, Extended European Search Report, Application No. 20150089.9, dated May 13, 2020, 6 pages.

(Continued)

*Primary Examiner* — Felix O Figueroa
(74) *Attorney, Agent, or Firm* — Quarles & Brady LLP

(57) ABSTRACT

A lockout device includes a plurality of rigid panels and a flexible body extending along an insertion axis which has, on one axial end thereof, a selectively closeable opening. The rigid panels are affixed to sidewalls of the flexible body with the rigid panels being positioned about the insertion axis. When the selectively closeable opening is opened, the flexible body and the plurality of rigid panels collectively define an interior volume for reception of a pendant control or other terminally-positioned electrical structure on a cord through the selectively closeable opening. When the selectively closeable opening is closed around the cord from which the pendant control or other terminally-positioned electrical structure extends, the pendant is secured in the interior volume and use of the pendant is inhibited by the plurality of rigid panels of the lockout device.

16 Claims, 10 Drawing Sheets

(56) References Cited

U.S. PATENT DOCUMENTS

| | | | | |
|---|---|---|---|---|
| 2003/0127345 | A1 | 7/2003 | Zuleta et al. | |
| 2014/0202219 | A1* | 7/2014 | Bolland | H01R 13/6397 70/32 |

OTHER PUBLICATIONS

Master Lock Company LLC.; Model No. 453L—Oversized Plug & Hoist Control Cover; Product Web Page https://www.masterlock.com/business-use/product/453L; printed Nov. 8, 2018; 2 pages.

* cited by examiner

LOCKOUT FOR PENDANT CONTROL OR OTHER TERMINALLY-POSITIONED STRUCTURE ON A CORD

CROSS-REFERENCE TO RELATED APPLICATION

Not applicable.

FIELD OF INVENTION

This disclosure relates to pendant lockouts for isolating pendant controls such as, for example, crane controls or other terminally-positioned structures on a cord such as, for example, suspended electrical outlets, extension cords, and portable electrical outlet boxes whether suspended or not.

BACKGROUND

When maintaining or repairing industrial equipment, workers utilize lock out/tag out (LOTO) devices to isolate and secure one or more energy control points. Energy control points of concern (for example, a valve, a circuit breaker, or so forth) are shut off or de-energized and LOTO devices are placed on the energy control points in order to prevent those energy control points from being turned back on or re-energized while the equipment is being worked upon. After all the work is done, the LOTO devices are removed from the energy control points and the energy control points may be turned back on or re-energized.

As one example, pendant controls may need to be isolated to prevent user operation of equipment during service. Pendant controls are often covered with a bag with a drawstring top. The bag can be made from a flexible material such as nylon. The drawstring is then pulled or cinched to enclose the pendant. The drawstring is then locked so that the bag can only be removed by authorized personnel.

SUMMARY

Soft lockable or cinchable bags used as lock out/tag out (LOTO) devices have many drawbacks. Most notably, the flexible material the bags are constructed from does not completely inhibit the actuation of pendant controls or other terminally-positioned structures on a cord. For example, a button of the pendant control might be depressed even when the bag covers the pendant and is locked if the material or fabric of the bag is sufficiently flexible.

This disclosure provides a LOTO device that surrounds a pendant or other terminally-positioned structure on a cord with flat, rigid surfaces incorporated into flexible fabric sections. This design better inhibits the operation of the pendant or use of the other terminally-positioned structure when the LOTO device is attached and further offers the benefit of being cleanly collapsible.

A lockout device is disclosed for a pendant control or other terminally-positioned structure on a cord. The lockout device includes a plurality of rigid panels and a flexible body extending along an insertion axis which has, on one axial end thereof, a selectively closeable opening. The rigid panels are affixed to sidewalls of the flexible body with the rigid panels being positioned about the insertion axis. When the selectively closeable opening is opened, the flexible body and the plurality of rigid panels collectively define an interior volume for reception of the pendant control or other terminally-positioned structure on a cord through the selectively closeable opening. When the selectively closeable opening is closed around the cord from which the pendant extends, the pendant is secured in the interior volume and use of the pendant is inhibited by the plurality of rigid panels of the lockout device.

In some forms, the flexible body may be a fabric material such as, for example, nylon.

In some forms, the selectively closeable opening includes a drawstring threaded through grommets affixed to the flexible body.

In some forms, the flexible body may include two telescoping portions extending along the insertion axis. Each of the two telescoping portions may have rigid panels affixed to sidewalls thereof with the rigid panels being positioned about the insertion axis. The rigid panels of one of the two telescoping portions may be able to slide along the insertion axis past the rigid panels of the other of the two telescoping portions. A stop may be affixed one or more of the two telescoping portions to inhibit movement of the two telescoping portions along a portion of the insertion axis. Still further to properly guide the telescoping portions with respect to one another, the rigid panels of one of the two telescoping portions may engage a groove of the other of the two telescoping portions. For example, this groove may be a dovetail groove and may be formed along the insertion axis to provide the desired guidance.

When there are telescoping portions there may be a structure which helps to define a set of intermediate positions or overall axial length of the portions relative to one another. For example, one or more of the rigid panels on one of the telescoping portions may include snap tab ramps and another one or more of the rigid panels on the other of the telescoping portions may include snap tabs. The snap tabs may selectively flexing over the snap tab ramps to position one of the telescoping portions relative to the other. This positioning may be temporary and overcome by a pulling or pushing force that shifts the tabs over the ramps to another axial position that adjusts the overall length of the lockout device.

In some forms, the lockout device may further include a hinged rigid panel that is positioned on an axial end opposite the selectively closeable opening. This hinged rigid panel may be affixed to one or more of the rigid panels (of the side rigid panels) to further define a floor of the interior volume when the hinged rigid panel is down (such that the hinged rigid panel lies perpendicular to the insertion axis). Such a hinged rigid panel may be hingedly connected to one of the plurality of rigid panels by a living hinge.

In some forms, at least a portion of a surface of each of the rigid panels may be a planar surface. Among other things, this planar form can help ensure that a button on the pendant control contained inside of the lockout device cannot be depressed. However, the use of planar panels can also permit the device to be toggled between two states including a storage state (or closed state) in which each planar surface is parallel or coplanar to every other planar surface and the lockout device is generally flat and a usage state (or opened state) in which the rigid panels are non-parallel with one another to define the interior volume and permit acceptance of the pendant control.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION

Figure 1A:
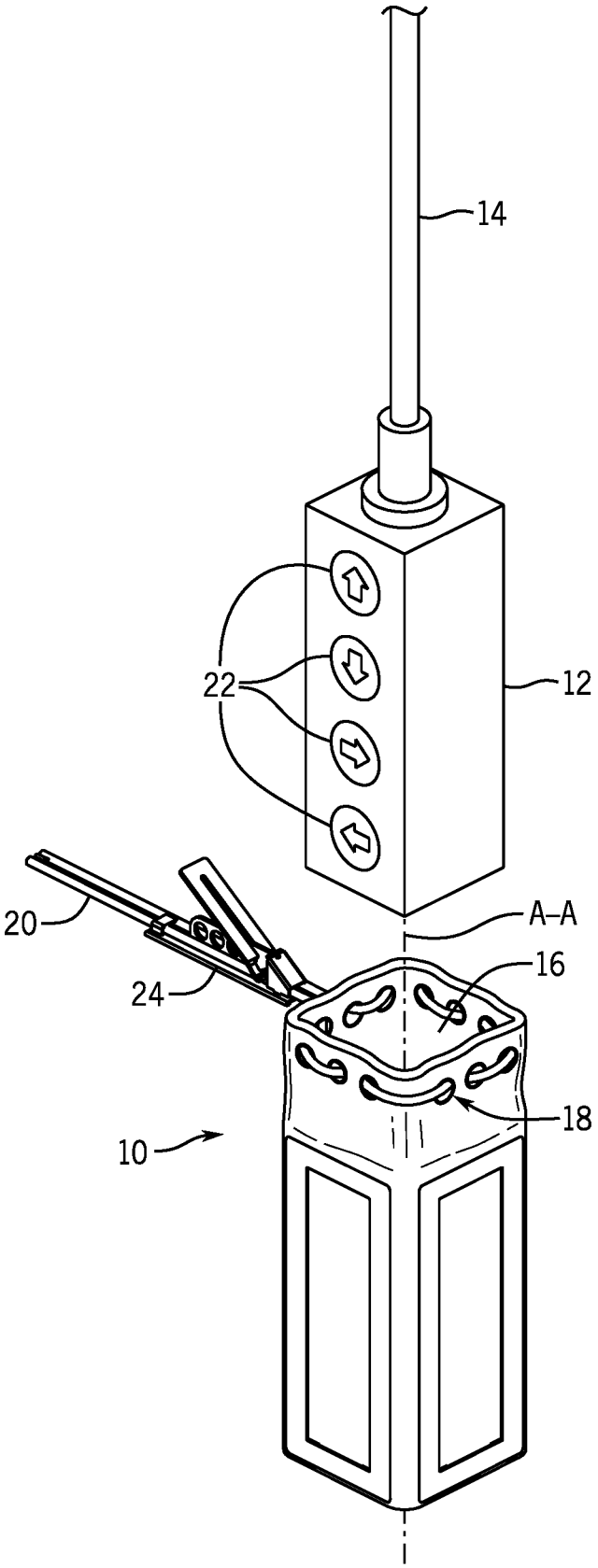
FIG. 1A shows a perspective view of a lockout device for a pendant extending from a cord with the pendant not yet received or secured within the lockout device, and with a selectively closeable opening of the lockout device open.
Figure 1B:
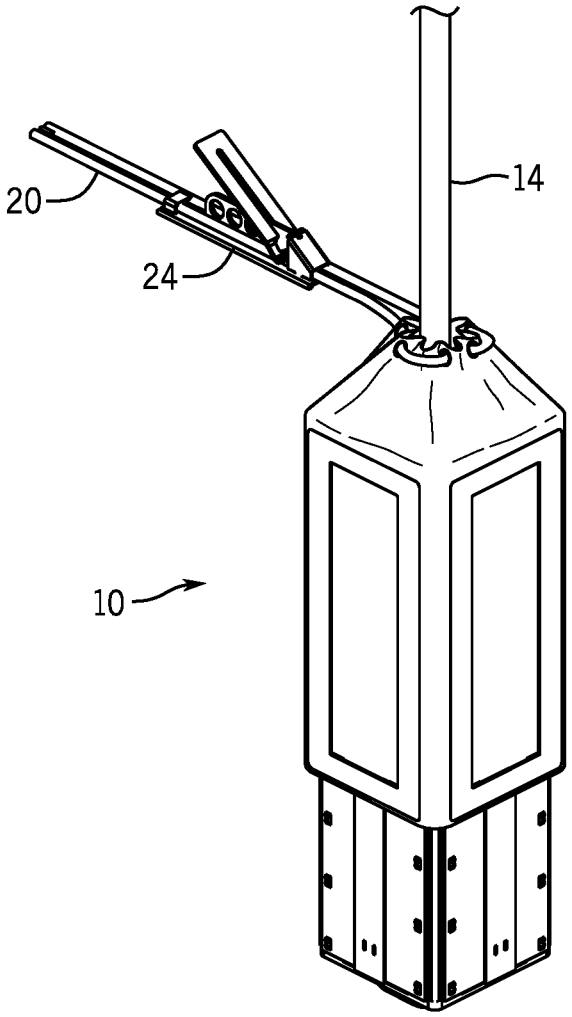
FIG. 1B shows a perspective view of the lockout device of FIG. 1A with the pendant secured within the lockout device and the selectively closeable opening of the lockout device cinched closed.

Referring first to FIGS. 1A and 1B, a perspective view of a lockout device 10 is shown for a pendant 12 that extends from a cord 14. On one axial end thereof, the lockout device 10 has a selectively closeable opening 16 for receiving and selectively securing the pendant 12 inside the interior volume of the lockout device 10 which is sized to accept and accommodate the pendant 12 along an insertion axis A-A. The pendant 12 typically contains one or more buttons or switches 22 that control industrial equipment. By placing the pendant 12 inside the lockout device 10, the use of the pendant 12 by actuation of the buttons or switches 22 (whether intentional or accidental) can be prevented while the equipment controlled by the pendant 12 is being serviced, for example.

As mentioned above, it is contemplated that the lockout device 10 can be used for devices other than the pendant 12. Such devices include other terminally-positioned electrical structures on a cord such as pendant outlets, suspended electrical outlets, extension cords, portable electrical outlet boxes, work lights, or drills whether the cord is dangling or not. It is also contemplated that the lockout device 10 can be used for a terminally-positioned pneumatic or hydraulic structure on a hose such as pneumatic wands or impact wrenches or water hose nozzles.

At the onset, it is noted that, as illustrated FIGS. 1A and 1B, the lockout device 10 is in a usage state or opened state in which the lockout device 10 defines an expanded interior volume accessible through the selectively closeable opening 16. However, this lockout device 10 is also collapsible to the configuration shown in FIGS. 7A and 7B in which the lockout device 10 is flattened into a storage state or closed in which the lockout device 10 is not capable of receiving a pendant 12 or other terminally-positioned structure on a cord, but rather is configured for storage between uses.

Returning to FIGS. 1A and 1B, the pendant 12 is shown prior to insertion in the lockout device 10 in FIG. 1A and inserted into the lockout device 10 just prior to securement in FIG. 1B.

In FIG. 1A, the selectively closeable opening 16 of the lockout device 10 is opened or expanded to accommodate reception of the pendant 12 into the interior volume of the lockout device 10. As illustrated, this selectively closeable opening 16 includes grommets 18 with a drawstring 20 threaded therethrough such that, when the drawstring 20 is cinched, it closes the opening 16 to the state illustrated in FIG. 1B. It is contemplated that other closure mechanisms could be used to similar effect. For example, the drawstring 20 could be threaded through a looped sleeve around the top of the selectively closeable opening 16 in order to cinch or close the selectively closeable opening 16 opening without the use of grommets.

Referring now to FIG. 1B, a perspective view of the lockout device 10 secured around the pendant 12 is shown. In this view, the pendant 12 has been inserted axially into the lockout device 10 along axis A-A such that only the cord 14 extends through the opening 16 and the selectively closeable opening 16 has been closed around the cord 16 by pulling the ends of the drawstring 20 simultaneously. A locking clamp 24 is then drawn up and locked on the drawstring 20 (for example, by pinching the drawstring 20 to prevent sliding of the clamp 24 relative to the drawstring 20 and by placing a padlock on clamp 24 to prevent the clamp 24 from being opened to an unpinching position) in order to prevent the uncinching of the drawstring 20. In this state, the pendant 12 is secured within the lockout device 10, thereby preventing its operation as will be further detailed below, and the lockout device 10 hangs from the cord 14 and is captured around it, such that the lockout device 10 cannot be axial removed without uncinching the drawstring 20.

Figure 2:
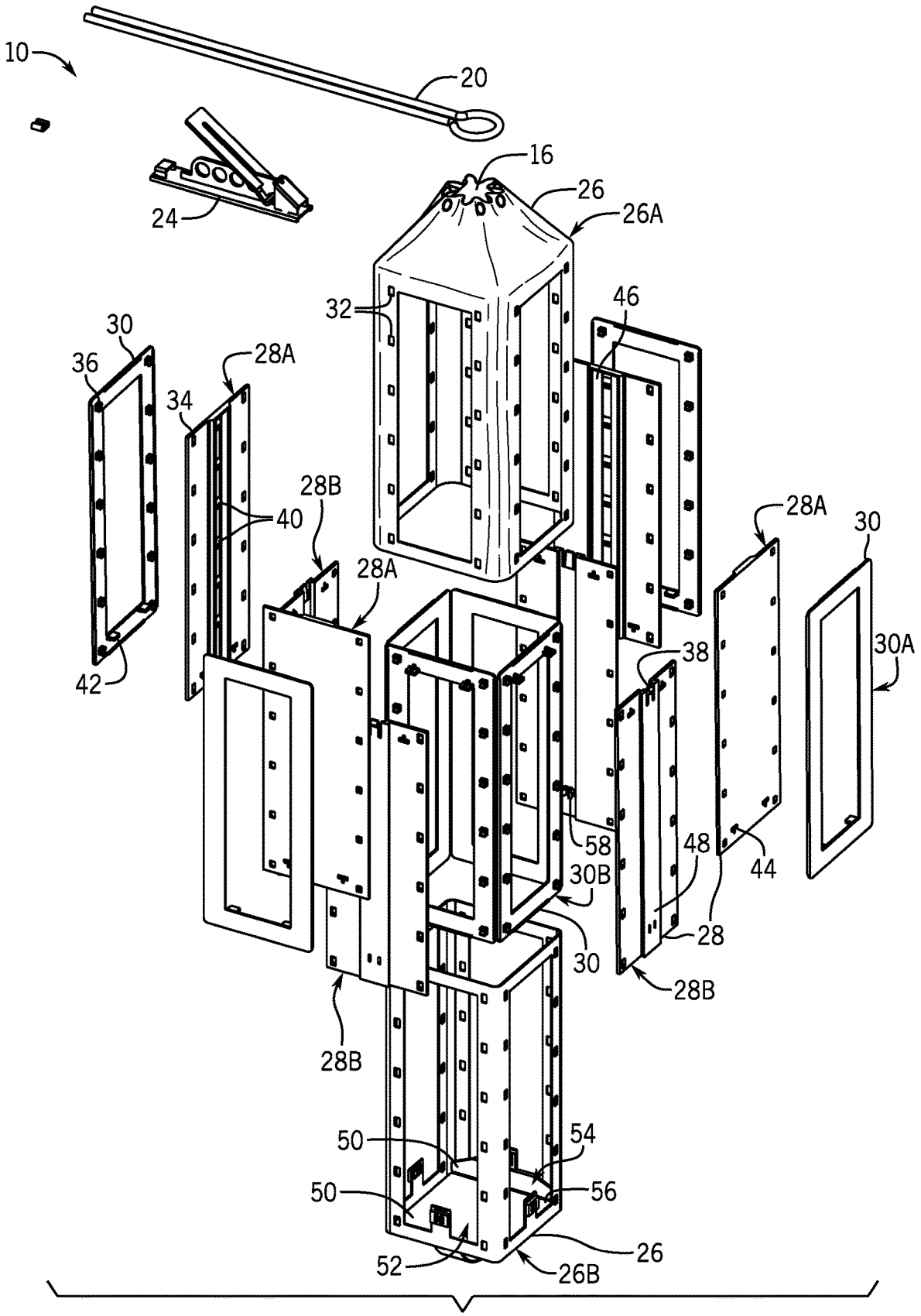
FIG. 2 shows a perspective view of the lockout device of FIGS. 1A and 1B with parts exploded.

With further reference being made to FIG. 2, a perspective view of the lockout device 10 with its parts exploded is shown to better illustrate its constituent components.

The lockout device 10 includes a flexible body 26 extending along the insertion axis A-A with the selectively closeable opening 16 on one end thereof. The flexible body 26 is made from a flexible material, such as a fabric material like nylon.

Notably, the flexible body 26 has a rigid panels 28 affixed to its sidewalls about the central axis A-A. The rigid panels 28 are connected through the flexible body 26 to snap panels 30 positioned on a radially opposite facing sidewalls of the flexible body 26. The rigid panels 28 are made from a rigid plastic that resists deforming, and protects a pendant control or other terminally-positioned structure on a cord such as a drill from being accidentally activated.

To accommodate the connection of the rigid panels 28 and the snap panels 30 to secure the rigid panels to the flexible body 26, the flexible body 26 has holes 32 through which the rigid panels 28 engage the snap panels 30 thereby sandwiching portions of the flexible body 26 therebetween. More specifically, the rigid panels 28 each have openings 34 which receive and retain corresponding snap clips 36 of the snap panels 30 which extend through the holes 32 of the flexible body 26 during assembly. When the snap clips 36 are engaged with the openings 34, each respect rigid panels 28 is affixed to the flexible body 26. Additionally, the rigid panels 28 provide structural support for the flexible body 26 such that it generally retains its form in the regions of the rigid panels 28 and inhibits the deforming or penetration of lockout device 10 such that the pendant 12 might be operated.

While snap panels are illustrated as an exemplary form of attachment, it is contemplated that rigid panels could be secured to the flexible body in other ways without the use of the snap panels.

In the form illustrated in the figures, the lockout device 10 comprises two telescoping portions, an upper telescoping portion 25A and a lower telescoping portion 25B. The upper telescoping portion 25A is sized to telescopically receive therein the lower telescoping portion 25B. The upper telescoping portion 25A includes the selectively closeable opening 16 while the lower telescoping portion 25B includes a lower base wall for the lockout device.

Because this is a two part telescoping assembly, the upper telescoping portion 25A and the lower telescoping portion 25B have rigid panel assemblies to their respective flexible bodies that parallels the description described above in which the general description of a component (i.e., flexible body 26) corresponds to two different components associated with the two telescoping portions 25A and 25B (i.e., upper flexible body 26A and lower flexible body 26B). The upper flexible body 26A of the upper telescoping portion 25A is affixed to upper rigid panels 28A (positioned on a radially inward facing sidewall of the upper flexible body 26A) by upper snap panels 30A which are positioned on a radially outward facing sidewall of the upper flexible body 26A. The lower flexible body 26B of the lower telescoping portion 25B is affixed to lower rigid panels 28B positioned on a radially outward facing sidewall of the lower flexible body 26B by lower snap panels 30B which positioned on a radially inward facing sidewall of the lower flexible body 26B.

The particular arrangement described permits for the upper rigid panels 28A to be position on the inside, while the lower rigid panels 28B are positioned on the outside such that, given that the lower telescoping portion 25B is received in the upper telescoping portion 25A, the upper rigid panels 28A and the lower rigid panels 28B can be placed into close proximity, contact, or engagement with one another. It is also contemplated that the lower telescoping portion 25B could be sized to telescopically receive the upper telescoping portion 25A. In such case, the lower rigid panels 28B could then be positioned on the inside and the upper rigid panels 28A could be positioned on the outside to create similar engagement. In either case, this close proximity of the rigid panels relative to one another permits for various types of engaging structures to be present on the upper rigid panels 28A and the lower rigid panels 28B that effects or limits the movement of the corresponding upper telescoping portion 25A with respect to the lower telescoping portion 25B.

For example, structure may be included on these rigid panels that will be useful for guiding relative motion of the telescoping portions relative to one another. For example, a groove 46 on the upper rigid panels 28A can interface with a corresponding groove engagement section 48 on the lower rigid panel 28B to permit controlled sliding axial motion between the two telescoping portions.

Still further, structure may be provided on the rigid panels that creates a series of discrete axial extension positions. For example, each of the plurality of lower rigid panels 28B have a snap tab 38 formed therein and each of the upper rigid panels 28A have a snap tab ramps 40 formed therein. For the snap tabs 38 to travel over the snap tab ramps 40 during an extension or shortening motion of the portions 25A and 25B relative to one another, the snap tabs 38 may need to be temporarily deformed by an applied force of the user during the extension or shortening or will otherwise "stick" in their current axial position. This will also be revisited later in this detailed description.

Additionally, there may be structure on the rigid panels that prevent the pair of telescoping portions from being axially separated or withdrawn from one another altogether. For example, snap panels 30 are formed with at least one stop 42 which extends inwardly or outwardly through stop holes 44 in the corresponding rigid panel 28. Each of the stops 42 of the upper snap panels 30A occupy a similar axial alignment as each of the stops 42 of the lower snap panels 30B, such that the stops 42 of the upper snap panels 30A come in contact with the stops 42 of the lower snap panels 30B when the lower telescoping portion 26B is extended sufficiently in an axial direction away from the selectively closeable opening 16. At this most extreme of axial extension positions, the stops 42 can inhibit further axial movement, as will be described in more detail later.

In order to provide a solid bottom of the lockout device 10, a hinged rigid panel 50 is affixed to an inner sidewall (for example, one or more of the lower rigid panels 28B and/or lower snap panels 30B) of the lower telescoping portion 25B. The hinged rigid panel 50 has two planar sections including a planar floor section 52 and an attachment section 54 joined by a living hinge 56 connecting them. It is contemplated that the attachment section 54 can be mechanically locked using features on one or more of the lower rigid panels 28B and/or the lower snap panels 30B to fix the attachment section 54 thereto or therebetween. As illustrated, one of the lower rigid panels 28B have inwardly-extending retention teeth 58 that engage a corresponding opening on the attachment section 54 to affix the attachment section 54 to the lower rigid panel 28B. This is most clearly understood comparing the exploded view of FIG. 2 and the assembled view of FIG. 6.

Figure 6:
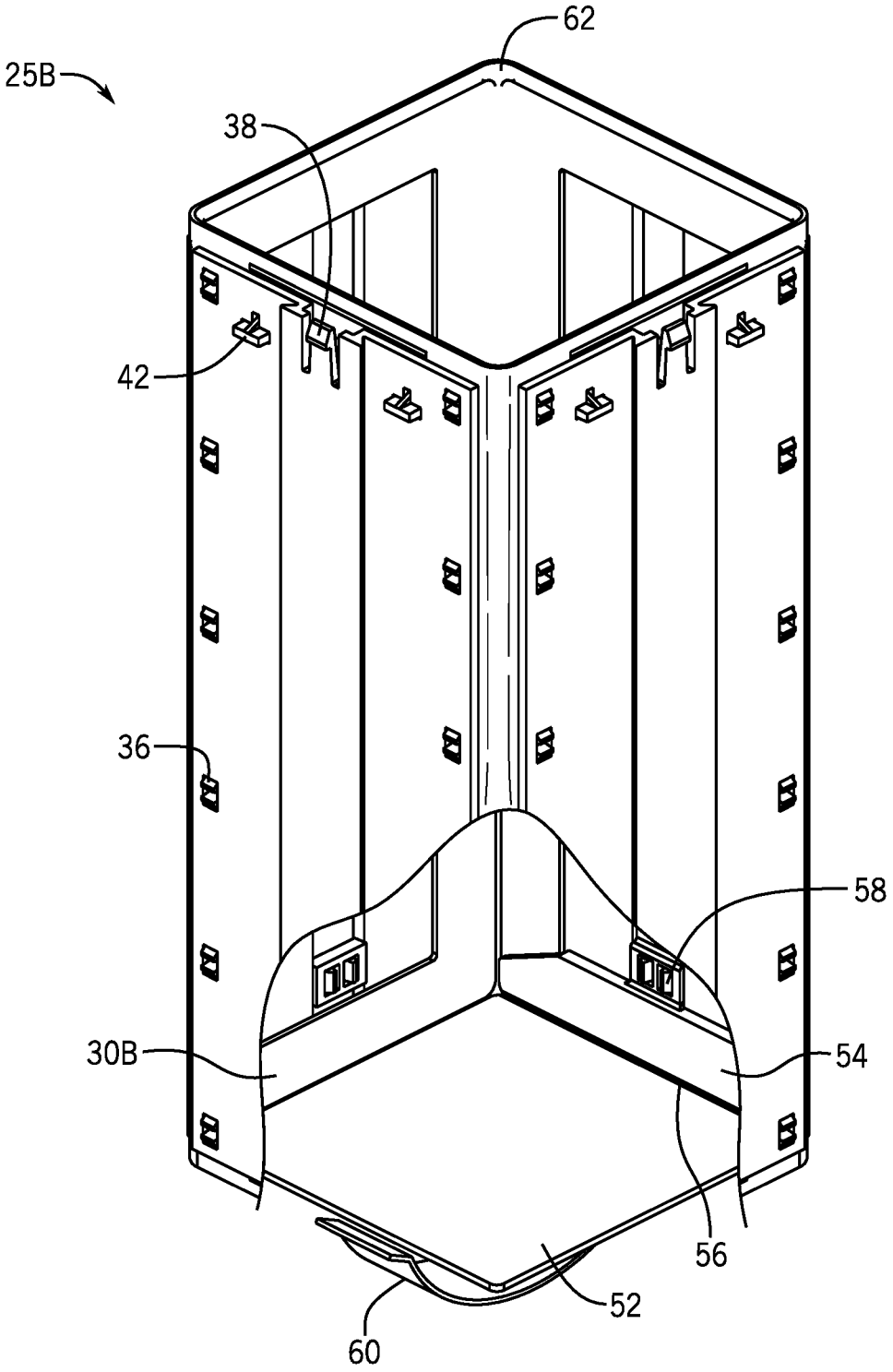
FIG. 6 shows cutaway view of the lockout device of FIG. 3B with a folded down hinged rigid panel that serve as a floor of the interior volume of the lockout device.
Figure 7A:
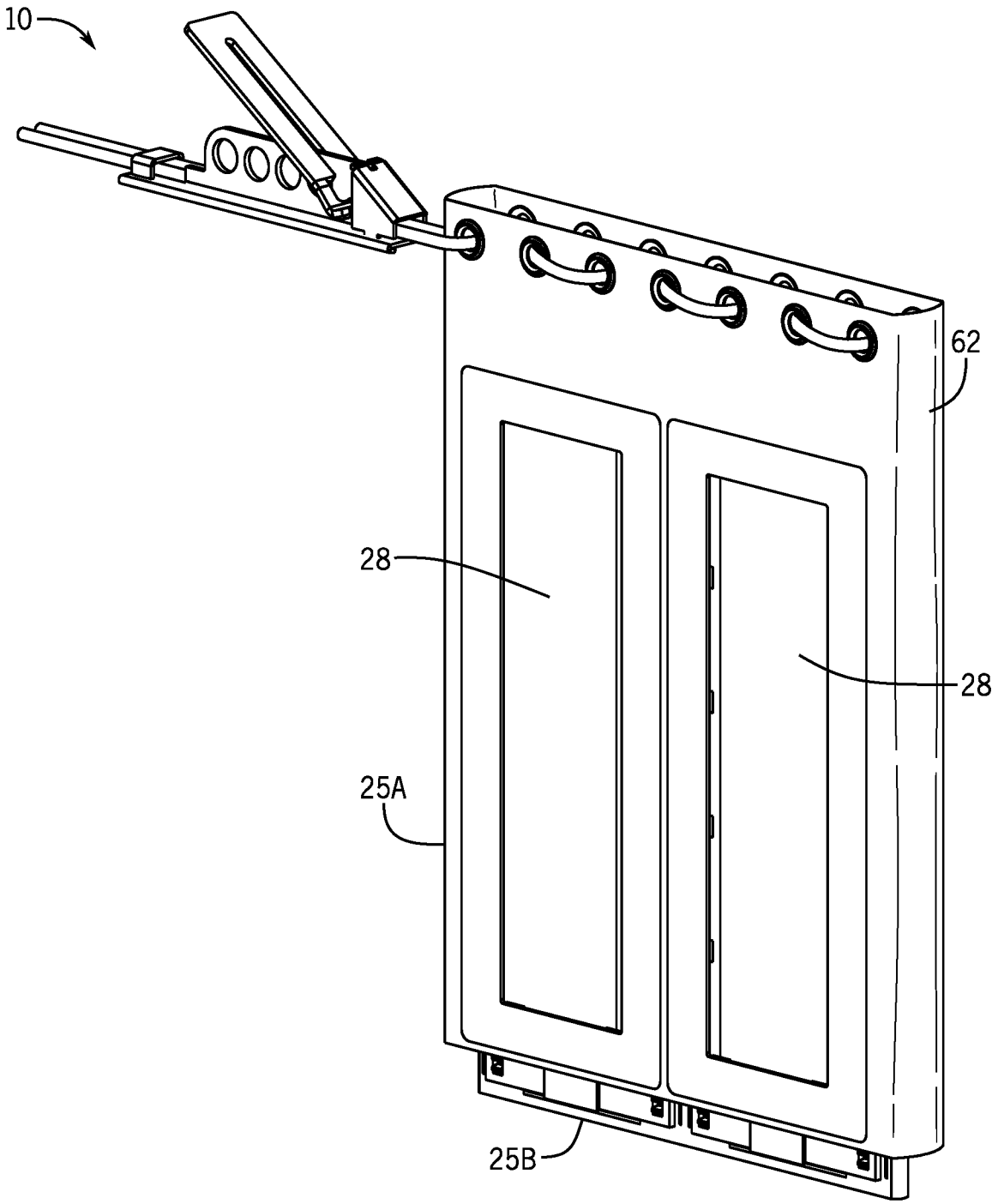
FIG. 7A shows a perspective view of the lockout device of FIG. 3B in a storage state in which pairs of the rigid panels have been brought together and the hinged panel lifted up to permit the lockout device to lay relatively flat.
Figure 7B:
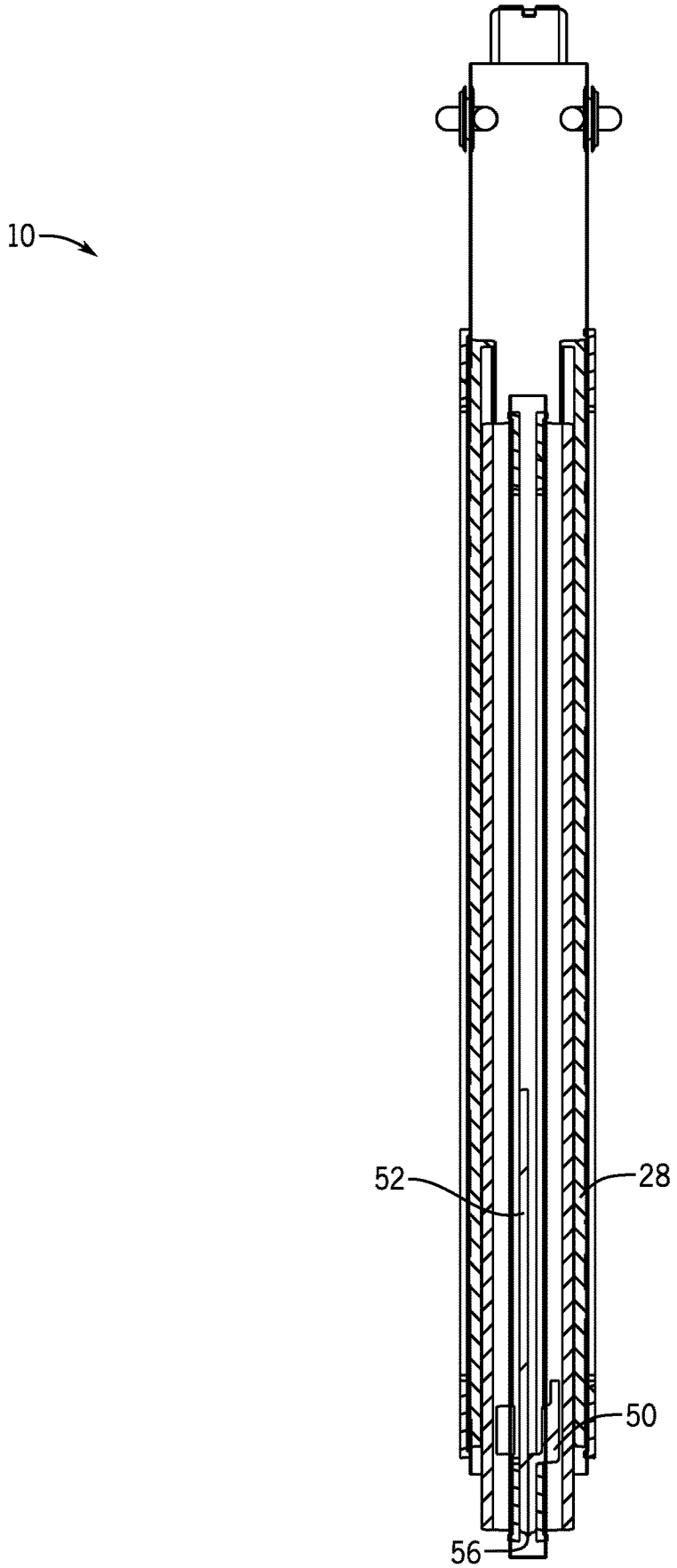
FIG. 7B shows a cutaway view of the lockout device of FIG. 7A in its storage state taken along a folding axis to better illustrate the stacking of the layers and the folded up hinged rigid panel that forms the floor in the opened or usage state.

Notably, the hinged rigid panel 50 is movable between two configurations with the hinged rigid panel 50 being foldable along the living hinge 56 to allow the sections 52 and 54 to be either perpendicular to or parallel with one another. In the perpendicular or "floor configuration" the sections 52 and 54 are perpendicular to one another such that the planar floor section 52 provides a floor of the lockout device 10 in the usage or opened state of the lockout device 10. In this configuration, which is shown in FIG. 6, the planar floor section 52 can support the flexible body 26, inhibit the deforming or penetration of lockout device 10 through the bottom side of the lockout device 10, and help to maintain the lockout device 10 in the usage position (i.e., make it harder for it to collapse into the storage state). However, the sections 52 and 54 may also be fold into one another at the living hinge 56 to a "closed configuration" when the lockout device 10 is collapsed into the storage position as is illustrated in FIGS. 7A and 7B.

Figure 3B:
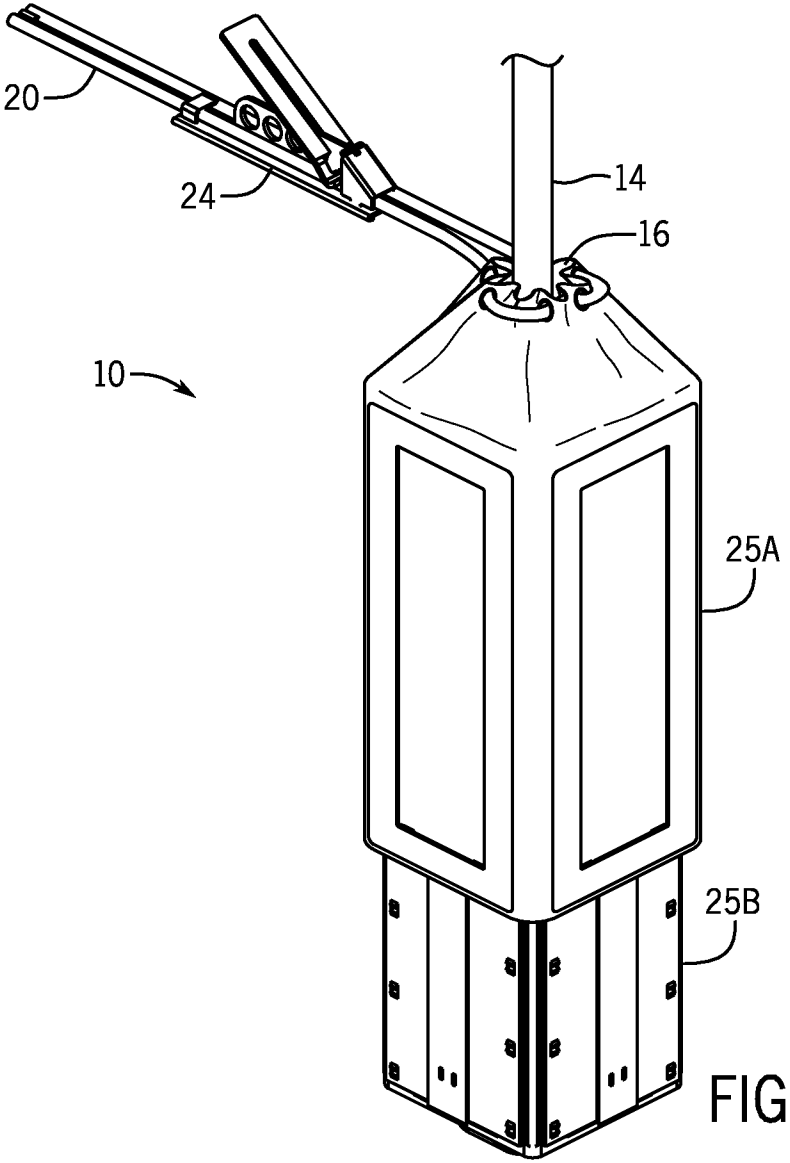
FIG. 3B shows a perspective view of the lockout device of FIG. 3A with one of the telescoping portions of the lockout device extended out along an insertion axis of the lockout device to extend the axial length of the lockout device.
Figure 3A:
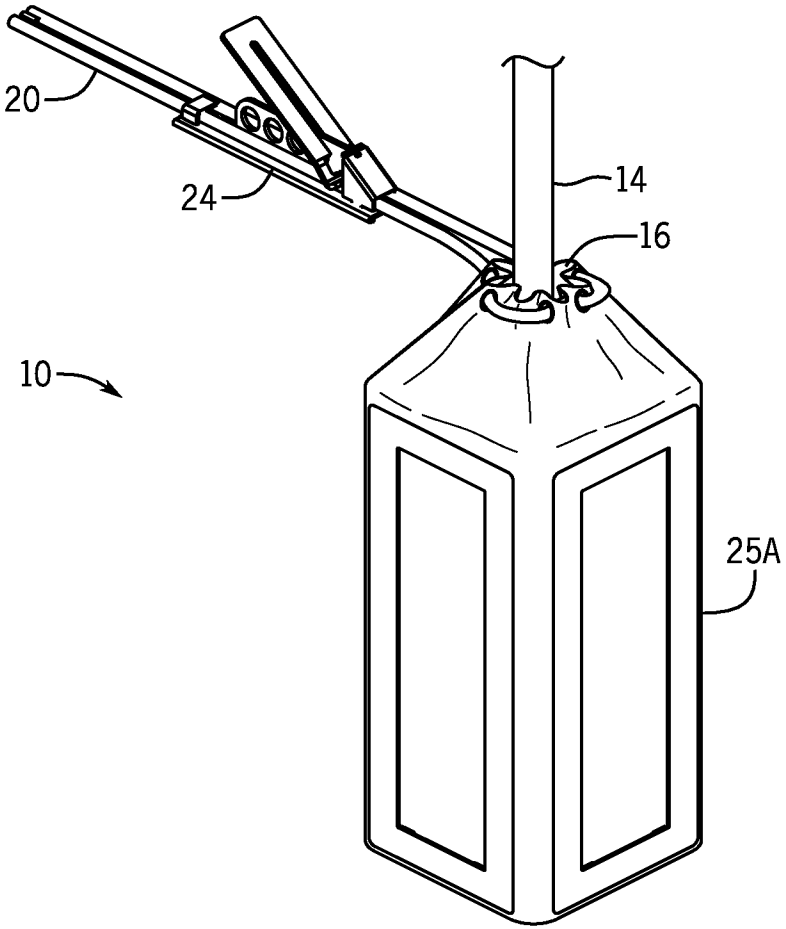
FIG. 3A shows a perspective view the lockout device of FIG. 2 in a non-extended state in which one of the two telescoping portions is completely received in the other.

Referring now to FIGS. 3A and 3B, the lockout device 10 is shown in the usage state in both a retracted state and an extended state, respectively. In FIG. 3A, in the retracted state, the lower telescoping portion 25B is retracted axially toward the selectively closeable opening 16 such that the lockout device 10 is in its most compact usage state. The lockout device 10 may be used in a non-extended state to lockout a short pendant or to prepare the lockout device 10 for storage, as will be described later. In FIG. 3B, in the extended state, the lower telescoping portion 25B is extended out from the upper telescoping portion 25A and away from the selectively closeable opening 16 into an extended state. In this extended state, the lockout device 10 is capable of receiving a longer pendant. In moving between the retracted state of FIG. 3A to the extended state of FIG. 3B, the various rigid panels 28 can slide past each other and the lockout device 10 can define an interior volume of variable size which may be sized appropriately for a given application or length of pendant.

As mentioned above and in consideration of the extended position shown in FIG. 3B, it is again noted that the stops 42 can interact with each other to inhibit movement in an axial direction so that the telescoping portions 25A and 25B are not axially separable from one another (thereby potentially providing access to a pendant or other terminally-positioned structure on a cord received therein). More specifically, when extended to the maximum possible extent, the stops 42 of the lower snap panels 30B catch on or engage the stops 42 of the upper snap panels 30A. In this way, the lower telescoping portion 25B is restricted from being removed entirely from the upper telescoping portion 25A, preserving the protection of the interior volume of the lockout device 10.

Figure 3C:
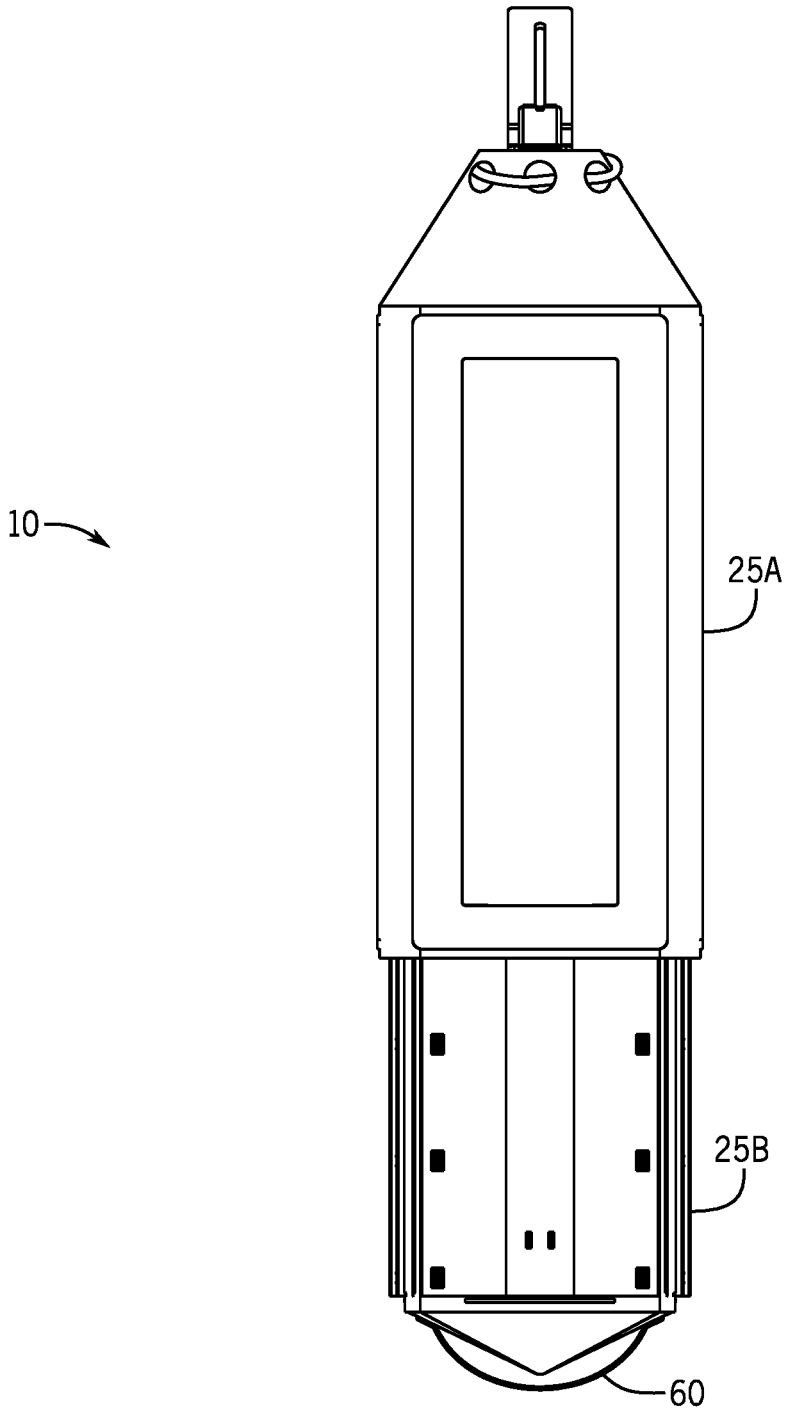
FIG. 3C shows a side view of the lockout device of FIG. 3B including a bottom handle for effectuating the movement of the telescoping portions relative to one another.

With additional reference being made to FIG. 3C, a side view of the lockout device 10 is provided in which a handle 60 is shown that accommodates movement of the telescoping portion 25A and 25B relative to one another. As illustrated, the handle 60 is a strap affixed to a lower or bottom fabric wall of the lower telescoping portion 25B. The handle 60 can allow a user to exert a pulling force to the lower telescoping portion 25B to cause the axial extension of the telescoping portions 25A and 25B relative to one another. Such handle 60 might also be gripped to move the lower telescoping portion 25B into the upper telescoping portion 25A to cause the retraction or shortening of the lockout device 10, although the utility of the handle 60 is likely greater in the "pulling" rather than the "pushing" direction.

Figure 4:
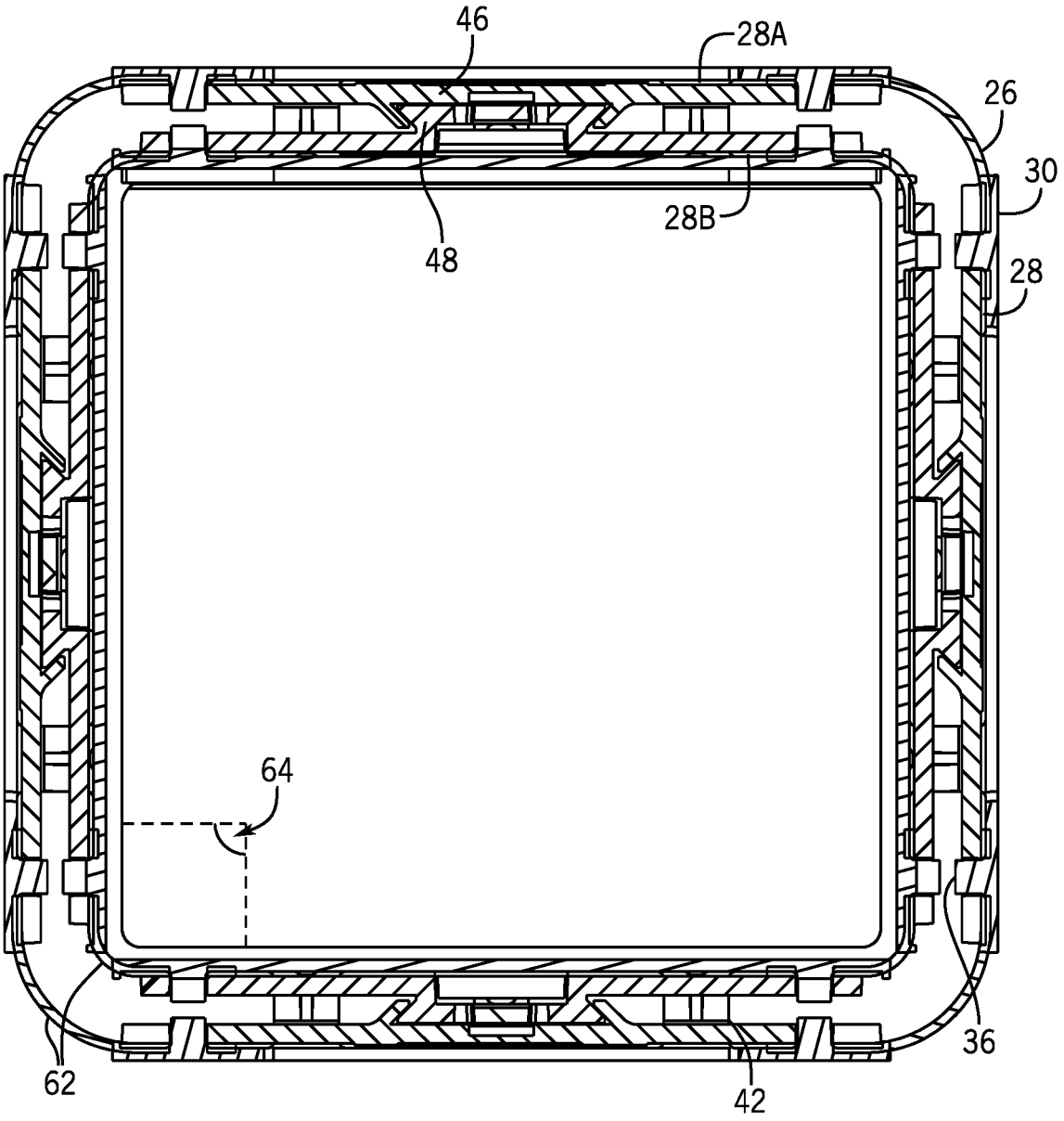
FIG. 4 shows a cross-sectional view of the lockout device of FIG. 3B taken along the insertion axis illustrating the guided engagement structure of the two telescoping portions.

With reference to FIG. 4, a cross-sectional view of the lockout device 10 taken along the insertion axis A-A showing the two joined and engaged telescoping portions.

This view illustrates that, between the rigid panels 28 of the lockout device 10, the flexible bodies 26 have corners 62. These corners 62 are relatively short lengths of material that permit the limited movement adjacent rigid panels relative to one another and also is small enough to prevent excessive deforming of the flexible body 26 to avoid a pendant from being activated within the interior volume of the lockout device 10 through the fabric forming the corners 62. With respect to limited movement, the corners 62 allow the rigid panels 28 to move between a range of panel angle 64 values while maintaining the rigid panels 28 approximately parallel to the insertion axis A-A. In other words, the plurality of rigid panels 28 may move non-axially to alert the panel angles 64, but will remain generally parallel with the central axis.

FIG. 4 illustrates that, for the embodiment shown, the panel angle 64 is 90 degrees, with each of the four sides being perpendicular to the adjacent sides. However, when the lockout device 10 is collapsed (when the hinged rigid panel 50 is lifted) the various panel angles 64 can range from approximately 0 degrees to 180 degrees. When collapsed into the storage state (illustrated in FIGS. 7A and 7B), the corners 62 permit the rigid panels 28 to fold flat into one another. Put differently the panel angle 64 between each rigid panel and an adjacent rigid panel might be shifted from 90 to approximately 0 degrees or 180 degrees.

The cross-sectional view of FIG. 4 also well illustrates the guides between the two telescoping portions 25A and 25B. As mentioned above, each upper rigid panels 28A have a groove 46 extending along the insertion axis A-A, such as a dovetail groove, while the lower rigid panels 28B have a corresponding groove engagement section 48 extending along the insertion axis A-A. The cross-sectional profiles of the groove 46 and the groove engagement section 48 are generally complementary, as the groove engagement section 48 is sized to fit at least partially within the groove 46. When the groove engagement section 48 are engaged with the groove 46, the upper rigid panels 28A and the lower rigid panels 28B can controllably slide past each other in the axial direction, while movement in other directions is limited (for example, the two telescoping portions 25A and 25B cannot rotate relative to one another).

Figure 5C:
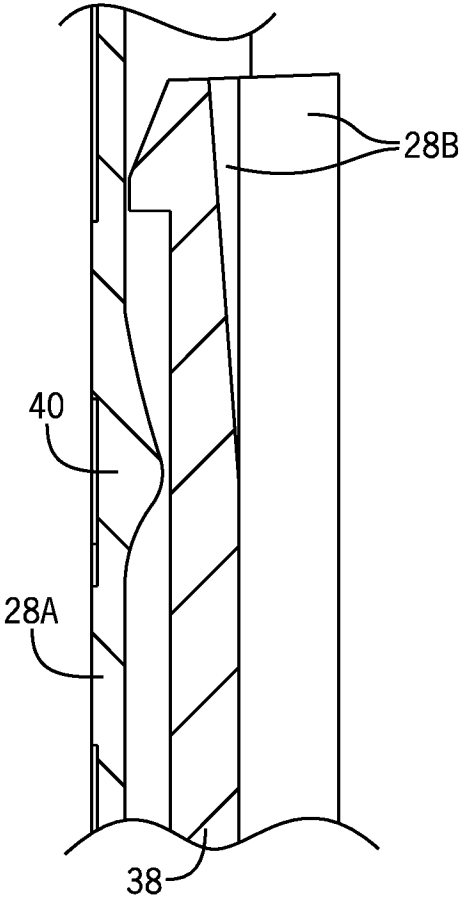
FIG. 5C shows a cross-sectional view of the snap tab of FIG. 5B after flexing over the snap tab ramp of FIG. 5B.
Figure 5B:
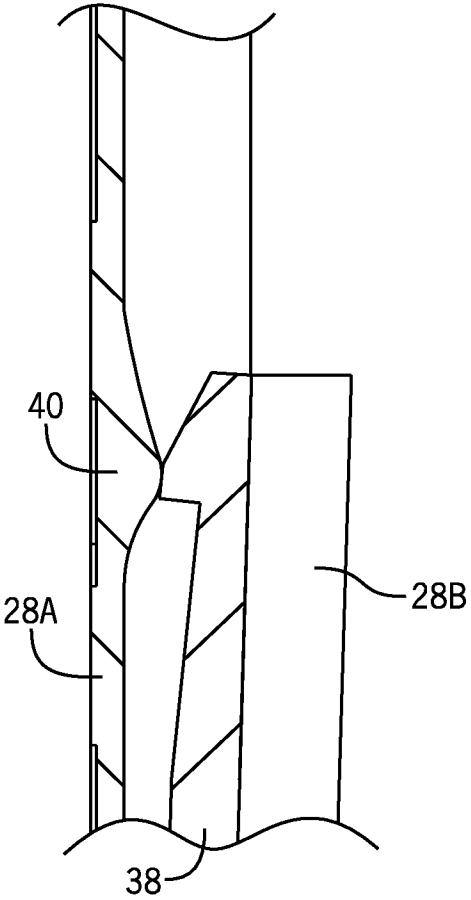
FIG. 5B shows a cross-sectional view of the snap tab of FIG. 5A flexing over the snap tab ramp of FIG. 5A.
Figure 5A:
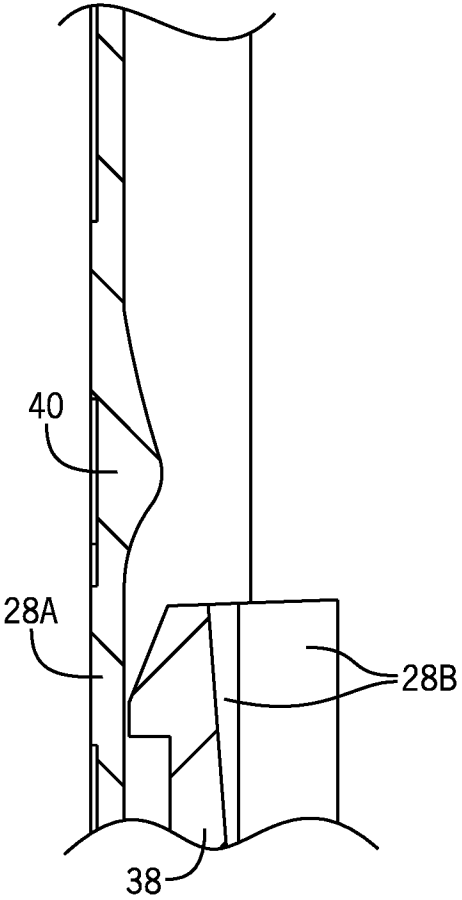
FIG. 5A shows a cross-sectional view of a snap tab of a rigid panel before flexing over a snap tab ramp of another rigid panel.

With further reference being made to FIG. 5A-5C, the use of the snap tabs 38 and snap tab ramps 40 is illustrated in greater detail. Again, these tabs 38 and tab ramps 40 can help establish and maintain an axial length of the lockout device 10 and positioning of the telescoping portions 25A and 25B with respect to one another during telescopic extension or retraction.

Looking first at FIG. 5A, a cross-sectional view of a snap tab 38 of an inner rigid panel 28B before the snap tab 38 is flexed over a snap tab ramp 40 of another outer rigid panel 28A. As mentioned above with respect to FIG. 2, each of lower rigid panels 28B have a snap tab 38 at a top end thereof, which can be similar to snap tab 38 illustrated in the detail of FIGS. 5A-5C. The snap tab 38 can be integrally formed into the panel 28B and extends upward proximate the top end of the rigid panel 28B. The snap tab 38 has a tang and a flexible arm, with the tang being deflectable under an applied force.

In FIG. 5A, the snap tab 38 is positioned axially below a snap tab ramp 40. While only a single snap tab ramp 40 is shown, there are actually multiple axially-spaced snap tab ramps over the length of the outer rigid panel 28A providing discrete axial positioning "stops" which may be overcome by the applied force of the user. In the position illustrated in FIG. 5A, the snap tab 38 is substantially un-flexed, resting on the upper outer rigid panel 28A beneath the snap tab ramp 40 and the snap tab ramp 40 prevents the snap tab 38 (and attached telescoping portion) from moving axially past the snap tab ramp 40 unless a sufficiently high threshold force is applied to the portions. The threshold force to flex the snap tab 38 so it may pass the snap tab ramp 40 should be moderately high; for example, the force will be greater than the force of gravity or the forces that are applied during routine handling/movement of the lockout device so that the telescoping portions do not slide past the respective snap tab/snap tab ramp axial positions unintentionally without the specific desire of a user to do so.

Turning now to FIG. 5B, a cross-sectional view of the snap tab 38 flexing over the snap tab ramp 40 is illustrated after the two telescoping portions have initially been moved relative to one another under the sufficiently high applied force of a user to those portions in order to adjust the overall length of the lockout device 10. The directionality as illustrated is specifically in a retraction or compaction direction. As shown in FIG. 5B, under the applied axial force of the user to the telescoping portions, the snap tab 38 is flexed radially inward, primarily at its neck, as the tang rides up the snap tab ramp 40.

Finally looking at FIG. 5C, the snap tab 38 is shown after traversing the snap tab ramp 40 and having flexed back to a substantially un-flexed position relative to the rigid panel 28B (albeit now on the other axial side of the snap tab ramp 40). Having traversed the ramp 40, the axial length of the overall lockout device 10 is adjusted. Further such adjustments may be made by further pushing together/pulling apart the telescoping portions to place the tabs 38 axial between the desired ramps 40 with the adjustment being substantially retained until sufficient force is applied to move the telescoping portions to a different respective axial position relative to one another.

Looking now at FIG. 6 (and with further reference back to FIG. 2), a cutaway view of the lower telescoping portion 25B of the lockout device 10 with the hinged rigid panel 50 in the aforementioned "floor configuration" is shown in which the planar floor section 52 of the hinged rigid panel 50 is oriented to be generally perpendicular to the central axis A-A, the various rigid panels of the lower telescoping portion 25B, and the attachment section 54. In this configuration, the peripheral edges of the planar floor section 52 (which is generally two dimensional planar square in shape) are positioned proximate the lower edges each of the four sides except for the side having the living hinge 56 which is simply attached to one of the rigid panel constructions.

As described above and with further reference being made to FIGS. 7A and 7B, the lockout device 10 is collapsible into a storage state. Again, this collapsing is possible because the corners 62 allow the plurality of rigid panels 28 to have a range of panel angles 64 between panels. When the hinged rigid panel 50 has the planar floor section lifted at its living hinge 56 to the lifted or closed configuration, the rigid panels 28 can be folded together so that all of the panels are coplanar with one another by flexing two opposing corners 62 to 0 degrees and the two other opposing corners 62 to 180 degrees. Thus, in the embodiment illustrated with two telescoping portions, there are two "stacks" of rigid panels each including two of the outer rigid panels and two of the inner rigid panels with fabric corners at the outermost ends and between the two stacks.

As described above, the hinged rigid panel 50 can fold up along the living hinge 56 and the planar floor section 52 can be made co-parallel with each of the rigid plates. The stack up, including the various rigid plates and the planar floor section 52 can be best seen in FIG. 7B.

Thus, a lockout device for pendant or other terminally-positioned structure on a cord is disclosed that uniquely has built-in rigid walls to prevent the inadvertent operation of the pendant enclosed therein. This device can be collapsible when not in use, so as to provide for convenient storage. Still further, the lockout device may have multiple telescoping sections to permit various axial lengths of pendants. Although a lockout device with all of these features is described and illustrated herein, it is contemplated that the design is readily adaptable to have some but not others of the various recited features. For example, a pendant lockout device might be made without telescoping section, but which is collapsible. Still further, a telescoping lockout device might be made without the ability to collapse. Still further the various detailed functionality relating to intermediate axial positions with snap tab/snap tab ramps may or may not be present or replaced with alternative positioning designs. Still further, other closure mechanisms beyond a cinching drawstring might be used to secure the pendant within the lockout device. Thus, it will be readily appreciated that the various aspects of the pendant lockout device may be included various permutations and combinations with one another in other contemplated embodiments.

As noted above, it should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A lockout device for a pendant control or other terminally-positioned structure on a cord, the lockout device comprising:

a plurality of rigid panels; and a flexible body extending along an insertion axis with a selectively closeable opening on one end thereof, the flexible body having the plurality of rigid panels affixed to sidewalls of the flexible body with the plurality of rigid panels being positioned about the insertion axis;

wherein, when the selectively closeable opening is opened, the flexible body and the plurality of rigid panels collectively define an interior volume for reception of the pendant control or other terminally-positioned electrical structure through the selectively closeable opening and, when the selectively closeable opening is closed around the cord from which the pendant control or other terminally-positioned electrical structure extends, the pendant control or other terminally-positioned electrical structure is secured in the interior volume and use of the pendant control or other terminally-positioned electrical structure is inhibited by the plurality of rigid panels of the lockout device.

2. The lockout device of claim 1, wherein the flexible body comprises two telescoping portions extending along the insertion axis, each of the two telescoping portions having the plurality of rigid panels affixed to sidewalls thereof with the plurality of rigid panels being positioned about the insertion axis.

3. The lockout device of claim 2, wherein the plurality of rigid panels of one of the two telescoping portions are slidable past the plurality of rigid panels of the other of the two telescoping portions along the insertion axis.

4. The lockout device of claim 3, wherein a stop is affixed at least one of the two telescoping portions to inhibit movement of the two telescoping portions along a portion of the insertion axis.

5. The lockout device of claim 3, wherein at least one of the plurality of rigid panels comprises a plurality of snap tab ramps and at least another one of the plurality of rigid panels comprises a plurality of snap tabs, the plurality of snap tabs configured to selectively flex over the plurality of snap tab ramps.

6. The lockout device of claim 3, wherein the plurality of rigid panels of one of the two telescoping portions are configured to engage a groove of the other of the two telescoping portions.

7. The lockout device of claim 6, wherein the groove is a dovetail groove.

8. The lockout device of claim 6, wherein the groove is formed along the insertion axis.

9. The lockout device of claim 1, wherein the lockout device further comprises a hinged rigid panel, the hinged rigid panel positioned on an axial end opposite the selectively closeable opening and affixed to at least one of the plurality of rigid panels to further define a floor of the interior volume.

10. The lockout device of claim 9, wherein the hinged rigid panel is hingedly connected to one of the plurality of rigid panels by a living hinge.

11. The lockout device of claim 9, wherein the hinged rigid panel is perpendicular to the insertion axis.

12. The lockout device of claim 1, wherein at least a portion of a surface of each of the plurality of rigid panels is a planar surface.

13. The lockout device of claim 12, wherein the lockout device includes both a storage state in which each planar surface is parallel or coplanar to every other planar surface, and a usage state wherein the plurality of rigid panels define the interior volume.

14. The lockout device of claim 1, wherein the flexible body is a fabric.

15. The lockout device of claim 14, wherein the fabric is nylon.

16. The lockout device of claim 1, wherein the selectively closeable opening includes a drawstring threaded through a plurality of grommets affixed to the flexible body.

* * * * *